US008230830B2

(12) United States Patent
Vattaneo

(10) Patent No.: US 8,230,830 B2
(45) Date of Patent: Jul. 31, 2012

(54) ELECTRONICALLY CONTROLLED HYDRAULIC SYSTEM FOR VARIABLE ACTUATION OF THE VALVES OF AN INTERNAL COMBUSTION ENGINE, WITH FAST FILLING OF THE HIGH PRESSURE SIDE OF THE SYSTEM

(75) Inventor: Francesco Vattaneo, Orbassano (IT)

(73) Assignee: C.R.F. Società Consortile per Azioni, Orbassano (Torino) (IT)

( * ) Notice: Subject to any disclaimer, the term of this patent is extended or adjusted under 35 U.S.C. 154(b) by 255 days.

(21) Appl. No.: 12/827,494

(22) Filed: Jun. 30, 2010

(65) Prior Publication Data

US 2010/0326384 A1 Dec. 30, 2010

(30) Foreign Application Priority Data

Jun. 30, 2009 (EP) ..... 09425252

(51) Int. Cl.
*F01L 9/02* (2006.01)

(52) U.S. Cl. ..... 123/90.12; 123/90.13; 91/392

(58) Field of Classification Search ..... 123/90.12, 123/90.13; 91/392; 137/511, 512
See application file for complete search history.

(56) References Cited

U.S. PATENT DOCUMENTS

| | | | | |
|---|---|---|---|---|
| 5,537,976 | A | 7/1996 | Hu | |
| 7,210,438 | B2 * | 5/2007 | Canino et | 123/90.55 |

FOREIGN PATENT DOCUMENTS

| | | |
|---|---|---|
| DE | 36 04 233 | 8/1987 |
| DE | 42 44 374 | 7/1994 |
| DE | 2006-008676 | 8/2007 |
| EP | 0 931 912 | 7/1999 |
| EP | 0 961 870 | 12/1999 |
| EP | 1 091 097 | 4/2001 |
| EP | 1 243 761 | 9/2002 |
| EP | 1 243 763 | 9/2002 |
| EP | 1 338 764 | 8/2003 |
| EP | 1 344 900 | 9/2003 |
| EP | 1 555 398 | 7/2005 |
| EP | 1 635 045 | 3/2006 |
| EP | 2 060 754 | 5/2009 |
| WO | 98/34014 | 8/1998 |

OTHER PUBLICATIONS

European Search Report EP 09425252.5 dated Dec. 4, 2009.

* cited by examiner

*Primary Examiner* — Ching Chang
(74) *Attorney, Agent, or Firm* — Nixon & Vanderhye P.C.

(57) ABSTRACT

An electronically controlled hydraulic system for variable actuation of the valves of an internal combustion engine is constructed for fast filling of the high pressure side of the system.

4 Claims, 10 Drawing Sheets

ELECTRONICALLY CONTROLLED HYDRAULIC SYSTEM FOR VARIABLE ACTUATION OF THE VALVES OF AN INTERNAL COMBUSTION ENGINE, WITH FAST FILLING OF THE HIGH PRESSURE SIDE OF THE SYSTEM

This application claims priority to European Application No. 09425252.5, filed 30 Jun. 2009, the entire contents of which is hereby incorporated by reference.

FIELD OF THE INVENTION

The present invention relates to a system for variable actuation of the valves of an internal combustion engine having one or more cylinders, comprising, for each cylinder:

at least one intake valve and at least one exhaust valve, each provided with spring return means adapted to return said valve to a closed position, hydraulic means including a pressurized fluid chamber, said pressurized fluid chamber having a volume which is variable by actuating a pumping piston facing the inside thereof, said pressurized fluid chamber being hydraulically connected to an actuator of said at least one intake valve or said at least one exhaust valve, to allow the variable actuation thereof, a tappet actuated by a respective cam, supported by a camshaft, to control said pumping piston, and consequently said actuator of said valve with variable actuation, by said hydraulic means, a solenoid valve hydraulically connected to said pressurized fluid chamber and to said actuator, said solenoid valve being adapted to set a hydraulic connection of said pressurized fluid chamber and of said actuator with an exhaust environment, to uncouple said valve with variable actuation from the related tappet and cause the closing thereof by means of said spring return means, a first tank defining said exhaust environment, a hydraulic supply line of said tank, connected thereto, and having a first check valve adapted to allow a fluid flow towards said tank only, a hydraulic accumulator, hydraulically connected to said first tank.

PRIOR ART

Systems of the above-mentioned type have been described and shown in several prior patents to the same Applicant, such as, for instance, European Patent EP 1555398 B1.

With reference to the annexed FIG. 1, a hydraulic system for variable valve actuation, developed by the same Applicant and denoted by 1, comprises a pair of valves 2, which are movable along their respective axes and cooperate with respective spring return means 3, adapted to return each valve towards a closed position. Each valve is operatively connected for actuation to a respective actuator 4. The system 1 further comprises hydraulic means including a pressurized fluid chamber C with variable volume, channels 4*a* hydraulically connected to the respective actuators 4, and a channel 5 hydraulically connected to the channels 4*a* and to the pressurized fluid chamber C.

A pumping piston 6 faces the inside of the pressurized fluid chamber C, whose walls are defined by a cylinder 6*a* and by the pumping piston 6 itself. A spring element 6*b* is arranged coaxial with the pumping piston 6 and to the cylinder 6*a*, and is interposed between them.

Within the cylinder 6*a*, which is fixed, the piston 6 is movable, by means of a tappet 7, preferably a rocker, which in turn is actuated by a cam 8 carried by a camshaft 9 rotatable around its own axis. The rocker 7 comprises a cam follower 7*a* and a fulcrum 7*b*.

In preferred embodiments, the cam 8 comprises a main lobe 10 and a secondary lobe 10*a*. If the cam 8 controls the intake valves, the secondary lobe 10*a* has an advanced timing with respect to the main lobe 10.

A solenoid valve 11, actuated by electrical control means (not shown) controls the connection of the pressurized fluid chamber C and of the actuators 4 with a first tank 12, which defines an exhaust environment.

The annexed drawings do not show the constructive details of the actuators 4, because such details can be put into practice referring to what has been described in the prior patents to the same Applicant, such as, for instance, EP1243763 B1, EP1338764 B1, EP1635045 B1, and also with the aim of making the drawings more readily and easily understandable.

In a preferred embodiment, the tank 12 is provided with air bleeding means, e.g. a hole 13 provided at the top. The first tank 12 is supplied with a work fluid, preferably oil coming from a lubricating circuit of the engine on which the system 1 is installed, via a hydraulic supply line 14 connected thereto, which branches from a manifold channel 14*a*, and via a first check valve 15.

The check valve 15 is adapted to allow a fluid flow towards the tank 12 only. A hydraulic accumulator 16 is hydraulically connected to the tank 12 via a channel 16*a*.

A basic feature of the operation of the systems for variable valve actuation of this type is the possibility to uncouple the motion of the valves 2 from the motion of the tappet 7 imparted by the cam 8. Specifically, the system 1 controls the valves 2, which are therefore valves with variable actuation, through the afore-mentioned hydraulic means, i.e. through the pressurized fluid chamber C, the channels 4*a*, 5, the actuators 4, and through the solenoid valve 11.

Oil flows towards the system from the manifold channel 14*a*, and enters the hydraulic supply line 14. After passing the check valve 15, the oil reaches the tank 12. The above-mentioned hydraulic means are normally completely filled with oil, but the amount of oil inside them may vary on the basis of the actuating needs, as it will be detailed in the following.

The pressurized fluid chamber C has a volume which is variable by the actuation of the piston 6 through the tappet 7. Specifically, when the cam 8 controls the actuation of the tappet 7, the latter transmits the motion to the pumping piston 6, which generates an oil flow inside the channel 5 heading towards the solenoid valve 11 and the channels 4*a*.

The action of the tappet 7 is countered by the pressure within the fluid chamber C and by the action of the spring member 6*b*.

The oil thereby reaches the actuators 4, which produce a lift of the valves 2.

A required condition for being able to produce a lift of the valves 2 consists in the solenoid valve 11 being kept, through an electric signal, in a closed state. The phrase "closed state" is meant to define a condition wherein the solenoid valve 11 cuts off the tank 12 from the channels 5, 4*a*, and therefore from the pressurized fluid chamber C and from the actuators 4. Thereby, the whole oil flow produced by the motion of the pumping piston 6 is sent to the actuators 4 controlling the valves 2.

If the solenoid valve 11 is switched, by the interruption of said electrical signal, to an open state, i.e. to such a condition that the solenoid valve 11 sets a hydraulic connection between the tank 12 and the channels 4*a*, 5 and the pressurized fluid chamber C, the oil flow generated by the pumping piston flows out, through the solenoid valve 11, towards the tank 12 and possibly towards the hydraulic accumulator 16, thereby obtaining a depressurization of the pressurized fluid chamber C and of the channels 4*a*, 5. Moreover, it should be noted that, irrespective of the state of the solenoid valve 11, the channels 4*a*, 5 are always hydraulically connected to each other.

Therefore, if the solenoid valve 11 is in an open state, the actuators 4 cannot exert on the valves 2 an actuating force adapted to counter the elastic return action produced by the spring return means 3, the latter causing therefore a fast closing of the respective valve 2, being only countered by the action of a hydraulic brake (not shown) within each actuator 4.

The constructive details of the above-mentioned hydraulic brake are not shown in the annexed figures, with the aim of simplifying the understanding thereof, and because they are per se known, for example, from EP 1 091 097 B1, EP 1 344 900 B1.

It is therefore possible to selectively uncouple the motion of the valves 2 from the motion of the tappet 7, by acting on the solenoid valve 11 and by connecting to an exhaust environment, defined by the tank 12, the actuators 4 and the pressurized fluid chamber C. The uncoupling thereby achieved allows to vary the lift and/or the opening and closing times of the valves 2, both between subsequent engine cycles and within the same cycle.

Moreover, referring to the annexed FIG. 2, the system of FIG. 1, of known type, may be provided in preferred embodiments with further components. In the embodiment shown in FIG. 2, wherein the components having the same reference number are identical to those in FIG. 1, a second tank 120 is hydraulically connected in series to the first tank 12, upstream of the first check valve 15 with reference to the oil flow direction allowed by the valve 15 itself, via an intermediate channel 120*a* flowing into the manifold channel 14*a*. The oil flow direction allowed by the valve 15 is evidently the same as the direction of the oil flow supplying the system 1, shown as F in FIG. 2.

A further check valve 121 is inserted into the channel 120*a* downstream of the outlet of the second tank 120, ad it is adapted to allow a fluid flow only from the second tank 120 towards the manifold channel 14*a*, and therefore towards the first tank 12.

The second tank 120 is advantageously provided with air bleeding means, specifically with a hole 122 provided at the top. It must further be noted that the bleeding means 122, as well as the bleeding means 13, may also flow out in a remote position from the respective tanks, for example they may be constructed as vent channels having a variously structured path.

The second tank 120 comprises an inlet for an ascending supply channel 123, arranged at a higher geometric level than an outlet of the second tank 120. Specifically, the ascending channel 123 has a higher geometric level than the intermediate channel 120*a*, located at the outlet of the tank 120, as well as than the manifold channel 14*a*.

The system 1 described herein, both in the embodiment of FIG. 1 and in the variant of FIG. 2, is functionally divided into a high pressure side and a low pressure side.

More specifically, the phrase "high pressure side of the system" is meant to denote a set of components including the actuators 4, the channels 4*a*, the channel and the pressurized fluid chamber C, therefore a environment which is hydraulically connected downstream of the solenoid valve 11, referring to the direction of oil inflow to said hydraulic means, and labelled with F' in FIG. 1 and in FIG. 2.

On the contrary, the set of environments hydraulically upstream of the solenoid valve 11, always taking as a reference the direction F', will be referred to as "low pressure side of the system". As a consequence, in the following the check valves 15, 121 will also be referred to as "first low pressure check valve" and "second low pressure check valve", thereby characterizing said valves from a functional point of view. As a matter of fact, both valves 15, 121 hydraulically connect environments which are arranged upstream of the solenoid valve 11, always with reference to the direction F'.

The low pressure side of the system comprises tanks or channels wherein the oil pressure is remarkably lower than the values attained within the high pressure chamber C, the channels 4*a*, 5 and the actuators 4.

GENERAL TECHNICAL PROBLEM

In the variable valve actuation system of known type and previously described there is a continuous alternation of emptying and filling of the high pressure side of the system.

After an emptying due to the opening of the solenoid valve 11, with the aim of uncoupling the motion of the valves 2 from the motion of the tappet 7, it becomes necessary to provide a filling of the high pressure side of the system, particularly of the chamber C, in order to produce again a motion of the valves 2. The filling of the high pressure side of the system must take place in an extremely short time, and must be completed before the solenoid valve 11 is switched to the closed state in order to isolate the tank 12 from the high pressure side.

The filling operation is generally critical, since the size and the geometry of the components are such that the passage areas, particularly those offered by the solenoid valve 11, are not always sufficient to ensure the filling of the high pressure side within the time requested by the system operation.

Specifically, a typical example of a situation wherein the filling operation of the high pressure side of the system is critical consists of the cold start-up of internal combustion engines, wherein the system 1 controls the intake valves.

In a solution previously proposed by the Applicant in EP-0961870 B1, such an engine is provided with a cam 8 having both the main lobe and the secondary lobe 10, 10*a* (FIG. 1 of the annexed drawings). More specifically, the lobe 10 is used to control a main lift of the intake valves, while the secondary lobe 10*a* is used to control a lift of the intake valves which is much lower than the main lift, and which aims at attaining an internal exhaust gas recirculation (internal EGR) effect.

By means of the secondary lobe 10*a*, with a timing advance with reference to the main lobe 10, it is possible to control an opening of the intake valves in an angular interval comprised within the opening angular interval of the exhaust valves. It should be noted that the angular interval corresponding to the secondary lobe 10*a* has a much extension width than the angular interval corresponding to the main lobe 10. Thereby there is produced a partial backflow of burnt gases towards the intake conduits, where they remain to be later re-sucked during the main lift of the intake valves controlled by the main lobe 10.

However, in engine cold startup conditions, the intake valve lift controlled by the secondary lobe 10*a* to achieve the internal EGR effect is disabled by keeping the solenoid valve 11 open in the angular interval which corresponds to the side lobe 10*a*. In such a situation, the high pressure side of the system undergoes a depressurization, and the oil flow produced by the motion of the pumping piston 6 is sent towards the exhaust environment defined by the tank 12 via the solenoid valve 11.

At the time of controlling the main lift of the intake valves, the filling of the high pressure side of the system must have been completed, in order to control the intake valves as needed. However, in known systems there is a single path through which oil can flow towards the high pressure side of the system, such path being made up by the solenoid valve 11 in an open state.

In the described condition, the exiguity of the passage area offered by the solenoid valve 11 is accompanied by a very high oil viscosity at low temperatures. The combination of these two factors remarkably decreases the oil flow towards the high pressure side of the system in the filling step, and consequently the high pressure side of the system is only partially filled after the closing of the solenoid valve 11, while the cam 8 is controlling the intake valve main lift.

In addition, at engine startup, a time interval of approximately five seconds exists during which the oil pump entrained by the motor has not yet produced a complete pressurization of the hydraulically downstream environment, including the system 1. During this time interval, due to the absence of a sufficient pressure level, it is not possible to generate a pressure gap between the tank 12 and the pressurized fluid chamber C, which makes it extremely difficult to let oil flow to the high pressure side of the system, and therefore to fill the latter up.

In this time interval it is possible to set a pressure gap between the tank 12 and the pressurized fluid chamber C only thanks to the pumping piston 6, which, during its return stroke controlled by the spring member 6*b*, depressurizes chamber C favouring oil inflow towards the latter. The so produced oil flow is however insufficient to ensure a complete filling of the high pressure side of the system.

Because of the insufficient filling of the high pressure side of the system, a part of the stroke of the pumping piston 6, controlled by the tappet 7, substantially does not produce any motion of the intake valves, because it only compresses the air trapped in the system.

Subsequently, when the stroke of the pumping piston 6 reaches such a value as to allow to send the oil flow to the channels 5, 4*a* and as to cause a consequent pressure rise within the latter, the system undergoes a sudden pressure rise within the pressurized fluid chamber C and in all the environments hydraulically connected with it, including the actuators 4 of the intake valves.

The annexed FIG. 3 shows a diagram tracing the pressure curve in chamber C, corresponding to the label "pressure" on the ordinate axis, as a function of the engine angle or crank angle in a normal filling condition of the high pressure side, with an internal EGR effect (curve A) and in an insufficient filling condition of the high pressure side of the system, for example following a cold startup (curve B) with disabled internal EGR effect.

The pressure reaches a maximum value which is about twice the maximum value reached in a normal filling condition, when the pumping piston 6 produces a gradual pressurization of the high pressure side of the system. In a condition of insufficient filling, after a first part of the stroke of the pumping piston 6, in which the latter faces a very low resistance, a second part of the stroke follows wherein the resisting force on the pumping piston rises nearly instantaneously, when it pressurizes oil within the high pressure side of the system.

This obviously generates an impulsive-type action on the structure of the system 1, which can jeopardize the mechanical strength of various components. In addition, referring to previously mentioned FIG. 3 and to FIG. 4, oil pressurization within the high pressure side of the system takes place later than in a normal filling condition of the same high pressure side.

Specifically, in the first part of the stroke of the pumping piston, there is performed substantially a compression of the air trapped in the system, followed by a pressurization of the oil contained therein when the volume of chamber C is sufficiently reduced.

Therefore, the first part of the stroke of the pumping piston 6, which normally controls the main lift of the intake valves, does not produce any motion of the valves themselves, which consequently remain in a closed state under the effect of the spring return means 3 for a crank angle interval corresponding to a cam angle needed to cover the above-mentioned first stroke section of the pumping piston 6.

It is therefore possible to produce an intake valve opening only at the moment when the oil within the high pressure side of the system is pressurized by the pumping piston 6.

As a consequence, the intake valve opening will take place later than it would in a situation of normal filling of the high pressure side of the system. In FIG. 4, there is indicated by D the main lift profile of each intake valve in a normal filling condition, while there is indicated by E the lift profile of each intake valve in the previously described condition of insufficient filling. Both curves are drawn as a function of the engine angle or crank angle.

The curve E is substantially identical, up to a vertical translation towards the horizontal axis of the drawing, to the curve D in the same crank angle interval. This is due to the fact that the lift profile shape is in all cases imposed by the geometry of the cam 8, and therefore the valves are bound to move with a law of motion corresponding to the profile imposed by the cam 8 in the corresponding angular interval. The lift values are obviously lower, because a part of the stroke of the pumping piston 6, and therefore a part of the lift of the valves 2, has been lost in order to compress the air trapped in the system.

The actual lift of each valve is therefore substantially equal to the lift generated by an operating mode of the system 1 named LVO, Late Valve Opening, which will be described in the following, but in this case this is not the result of an intentional actuation but it is an undesired effect.

The difference between the maximum lift in a normal filling condition and in an insufficient filling condition can be substantial, sometimes even amounting to a half. This does not allow the engine to intake a sufficient amount of air (or of air/gasoline mixture), which makes the engine startup extremely difficult. The problem is particularly evident in the case of diesel engines wherein in the absence of a sufficient amount of air it is difficult to achieve the conditions for fuel ignition.

The same Applicant has proposed, in the European Patent Application n. 08425451.5, still unpublished at the date of filing of the present Application, a system for variable actuation of the valves having a hydraulic line connected to the high pressure side of the system, wherein the oil flow is controlled by a check valve instead of a solenoid valve, which on the contrary is only used to connect the high pressure side of the system to an exhaust environment.

However, this does not solve the problem of filling the high pressure side of the system, because, even using a check valve, it is not possible to ensure a sufficient passage area for the optimal operation of the system in any operating condition. Moreover, the aforesaid check valve must control the whole oil flow needed by the system, thereby requiring considerable valve dimensions, which are definitely critical for the overall system dynamics.

OBJECT OF THE INVENTION

The object of the present invention is to solve the problems of the prior art, specifically to provide a system for variable actuation of the valves of an internal combustion engine, wherein the filling of the high pressure side of the system takes place completely and rapidly, in any operating condition.

SUMMARY OF THE INVENTION

This and other objects are achieved by a system for variable actuation of the valves of an internal combustion engine having the features described in the annexed claims, which are integral part of the technical disclosure herein provided in relation to the invention.

Specifically, the object is achieved by a system for variable actuation of the valves of an internal combustion engine having all the features described at the beginning of the present description, and moreover characterized in that it comprises a check valve hydraulically connected between said first tank and said pressurized fluid chamber, said second check valve being adapted to allow a fluid flow only out of said first tank towards said pressurized fluid chamber, said second check valve and said solenoid valve being hydraulically connected in parallel to each other, and being both adapted to allow the fluid supply from said first tank to said pressurized fluid chamber.

In this way, the passage area is increased during the filling process of the pressurized fluid chamber and of the entire high pressure side of the system, through the use of two components in parallel, i.e. the solenoid valve and said check valve.

Advantageously, the use of two hydraulic passages in parallel to each other makes it possible to limit the size of the check valve, therefore allowing the latter to provide remarkably readier responses during the system operation.

Further features of the invention are indicated in the appended claims.

BRIEF DESCRIPTION OF THE DRAWINGS

Further features and advantages of the invention will become clear from the following description, with reference to the annexed drawings, given merely by way of non limiting example, in which.

DETAILED DESCRIPTION OF PREFERRED EMBODIMENTS OF THE INVENTION

Figure 5:
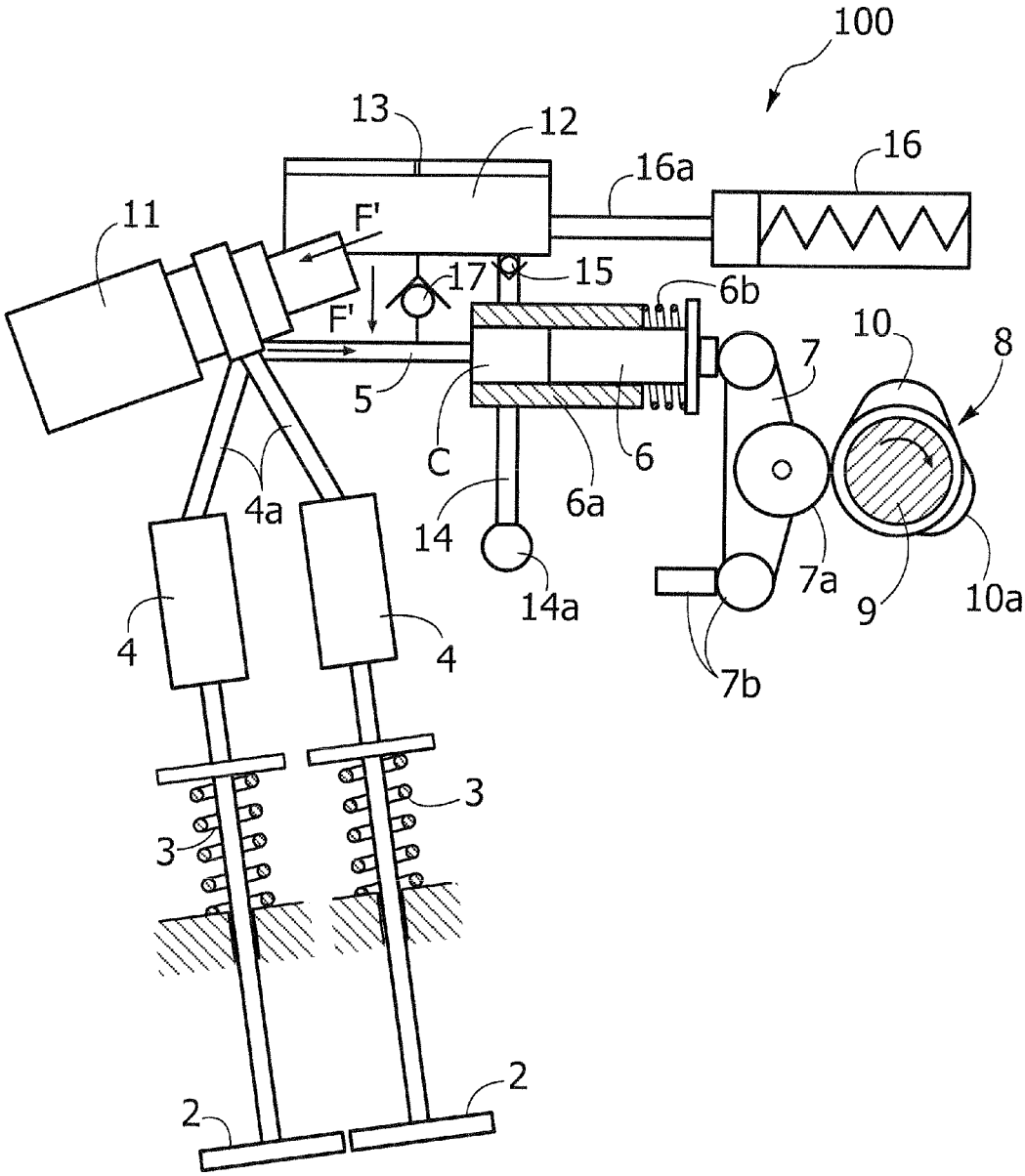
FIGS. 5, 6 show views of the systems of FIGS. 1, 2, modified according to the teachings of the present invention.

In FIG. 5, reference number 100 denotes a preferred embodiment of a system for variable actuation of the valves according to the present invention. System 100 is adapted to be installed on an internal combustion engine, and it can be in general employed both for intake valve actuation and for exhaust valve actuation.

The components corresponding to those shown in the previous Figures are labelled with the same reference number.

The system 100 comprises a check valve 17, hydraulically connected in parallel to the solenoid valve 11 between the tank 12 and the pressurized fluid chamber C. More specifically, the check valve 17 is hydraulically connected to the pressurized fluid chamber C via the channel 5. The arrangement of the check valve 17 is such that it is adapted to allow an oil flow out of the tank 12 only, specifically towards the pressurized fluid chamber C. In the following the check valve 17 will be referred to as "high pressure check valve", whose functional meaning will become clear from the following description, and is linked to the previously provided definition of high pressure side of the system.

The constructive details of the high pressure check valve 17 are neither described nor shown herein, as they can be accomplished in any known way. Typically, the valve 17 will comprise a valve body, defining a valve seat, and an obturator pushed towards said seat by spring means.

By the system 100, in critical conditions such as previously described, for example at a cold startup, it is possible to fill with oil the high pressure side of the system much more rapidly than in system 1 of known type. The high pressure check valve 17 and the solenoid valve 11 are both adapted to supply fluid to the high pressure side of the system, and particularly to the pressurized fluid chamber C.

In a system for variable actuation of the valves of the type described herein, it is necessary to provide the filling of the high pressure side of the system, particularly of the pressurized fluid chamber C, any time the latter is hydraulically connected to an exhaust environment, such as the tank 12, by the opening of the solenoid valve 11. This takes place in any operating condition wherein it is not necessary for the valves to move according to a full lift profile, corresponding to the lift profile geometrically instructed by cams and tappets.

The operating conditions wherein the high pressure side of the system is hydraulically connected to the tank 12 are many and comprise:

operating mode with early valve closing (EVC, Early Valve Closing), wherein the solenoid valve 11 remains in a closed state in an angular interval (in terms of a crank angle or cam angle) beginning at an opening start angle of the full lift profile and ending at an angle, variable as a function of the engine operating conditions, before a closing end angle of the full lift profile; in such a case, the closing of each valve, caused by the action of the spring return means 3, is very fast and it is only countered by the action of the hydraulic brake located within each actuator 4. This operating mode is associated with partial load conditions of the engine, operating mode with late valve opening (LVO, Late Valve Opening), wherein the solenoid valve 11 remains closed in an angular interval substantially centered with reference to a maximum lift angle of the full lift profile, and which is less wide than the whole angular interval corresponding to the above-mentioned profile; in this case, the valve opening is delayed and the lift profile corresponds to the ones of the full lift profile in the angular interval of the closing of the solenoid valve 11, with lower lift values, because a part of the oil volume of the pressurized fluid chamber C, displaced by the pumping piston 6, has been sent to the tank 12, and the remaining part is not able to produce lifts corresponding to the full lift profile. The lift profile corresponds in shape to the full lift profile in the same interval, because it is imposed anyway by the cam geometry; this operating mode is associated to the conditions of idling following startup, multi-lift operating mode, substantially consisting of a sequence of early valve closing (EVC) and late valve opening (LVO); this mode is associated to low load conditions or minimum rpm, typical of urban road travel, in order to optimize combustion.

The previously described operating modes are very meaningful because they are associated to most operating conditions of the engine, particularly those typical of urban road or country road travel, while generally the full lift profile is only associated to high load or full load conditions of the engine, with high torque demands.

It is therefore necessary to fill the high pressure side of the system substantially at each engine cycle, so that the system is always able to control the lift according to the predetermined mode as a function of the load and of the speed of the engine. The filling takes place, as described, by recalling oil from the tank 12 and the accumulator 16, which ensures a readier response of the system 100. Obviously, in case of a sequence of engine cycles wherein a full lift of the valves is actuated, a filling of the high pressure side of the system is not demanded, except for oil leak compensation.

The whole passage area through which oil is displaced from the tank 12 to the high pressure side of the system is higher, compared with the system 1 of known type, by an amount corresponding to the passage area of the high pressure check valve 17.

The time needed to fill the pressurized fluid chamber C is therefore greatly reduced, as the flow towards the chamber itself increases.

Nevertheless, it will be appreciated that in cold climatic conditions, when the oil flow is made difficult by the high viscosity, it is possible to reduce the pressure gaps needed to produce an oil flow and to complete the filling in the available time, thanks to the larger passage area available.

Moreover, in the case of application of the system 100 to the intake valves of an internal combustion engine with the use of cams 8 having the main lobe 10 and the secondary lobe 10*a*, with the aim of attaining an internal EGR effect, the problems described as pertaining to the prior art and concerning the cold startup conditions can be easily overcome.

Briefly recalling what already stated, in cold startup conditions with the solenoid valve 11 in an open state, the secondary lobe 10*a*, advanced in timing compared to the main profile 10 with reference to the rotation direction of the cam 8, brings about the emptying of the pressurized fluid chamber C, with a consequent supply of an oil volume to the tank 12. The oil volume sent to the tank 12 must therefore be re-filled in the pressurized fluid chamber C before the main lobe 10 acts on the tappet 7 to control the main lift.

Figure 3:
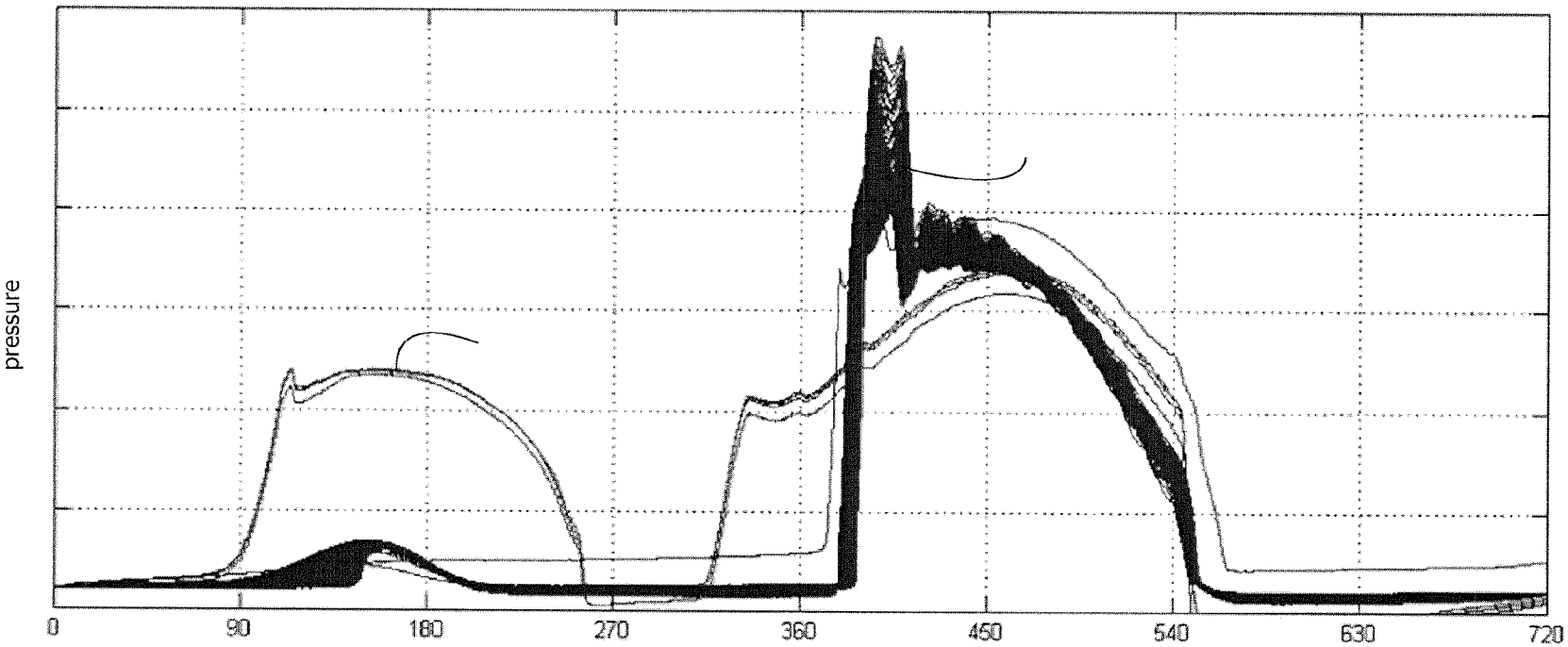
FIG. 3, previously mentioned, is a diagram showing the pressure trend within the pressurized fluid chamber of the system, as a function of the engine crank angle, in normal filling conditions and in insufficient filling conditions of said pressurized fluid chamber.
Figure 4:
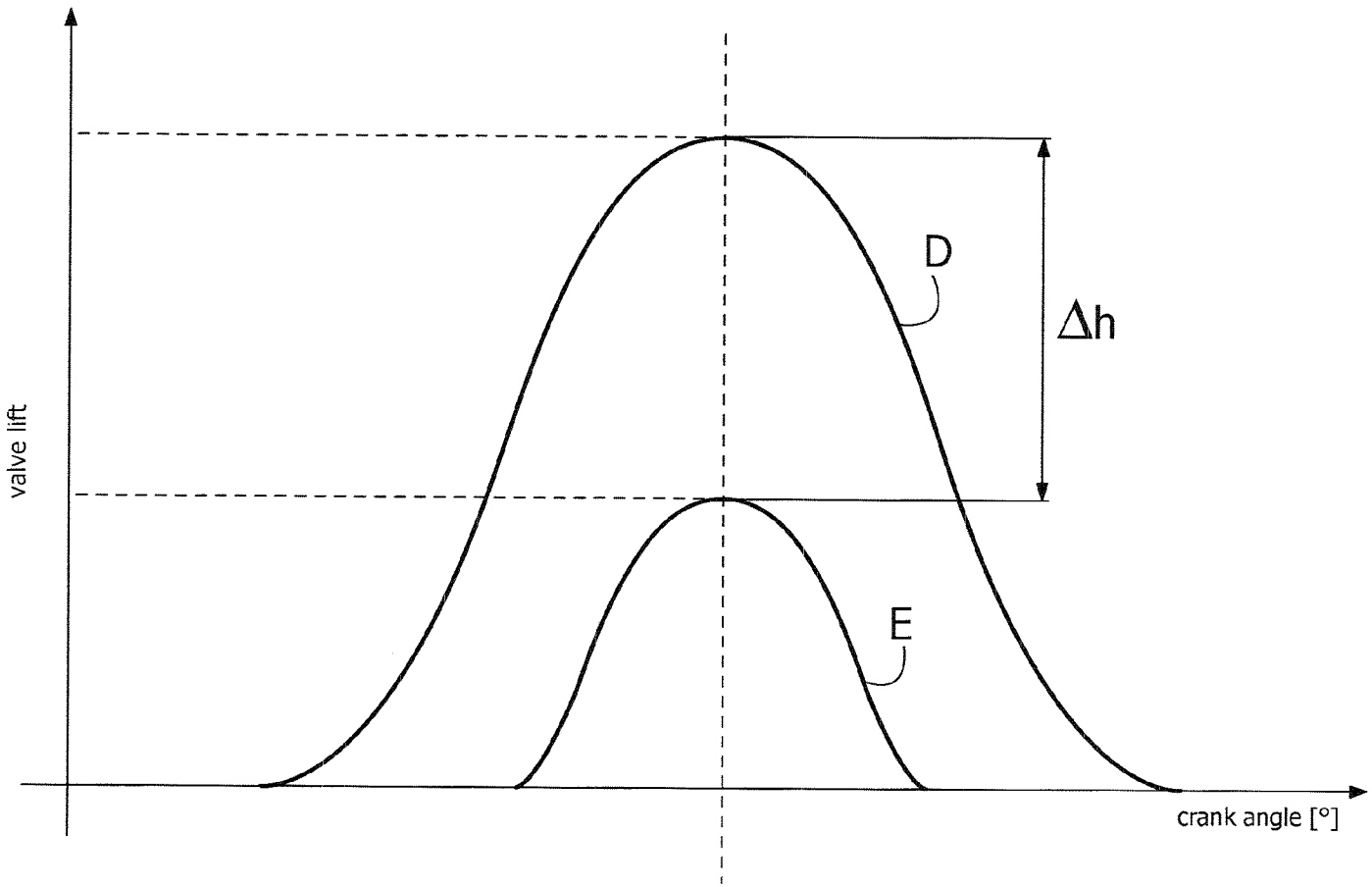
FIG. 4 is a diagram showing the trend of the valve lift profile in normal filling conditions and in an insufficient filling condition of the pressurized fluid chamber, as a function of the engine crank angle.

By exploiting the passage area altogether offered by the solenoid valve 11 and by the high pressure check valve 17, it is possible to complete the filling within the available time and without incurring the events, shown in FIGS. 3, 4, which are typical of the previously described systems of known type.

In addition, since the solenoid valve 11 and the high pressure check valve 17 are both adapted to the supply of the high pressure side of the system, particularly of the pressurized fluid chamber C, it is possible to install a high pressure check valve 17 of limited size, therefore with a readier response. This is obviously possible thanks to the fact that oil can flow both through the solenoid valve 11 and through the high pressure check valve 17, differently from what is typical of some systems proposed by the same Applicant and previously mentioned, wherein oil can flow towards the high pressure side only through a check valve, which therefore has a considerable size and poor response readiness.

Figure 6:
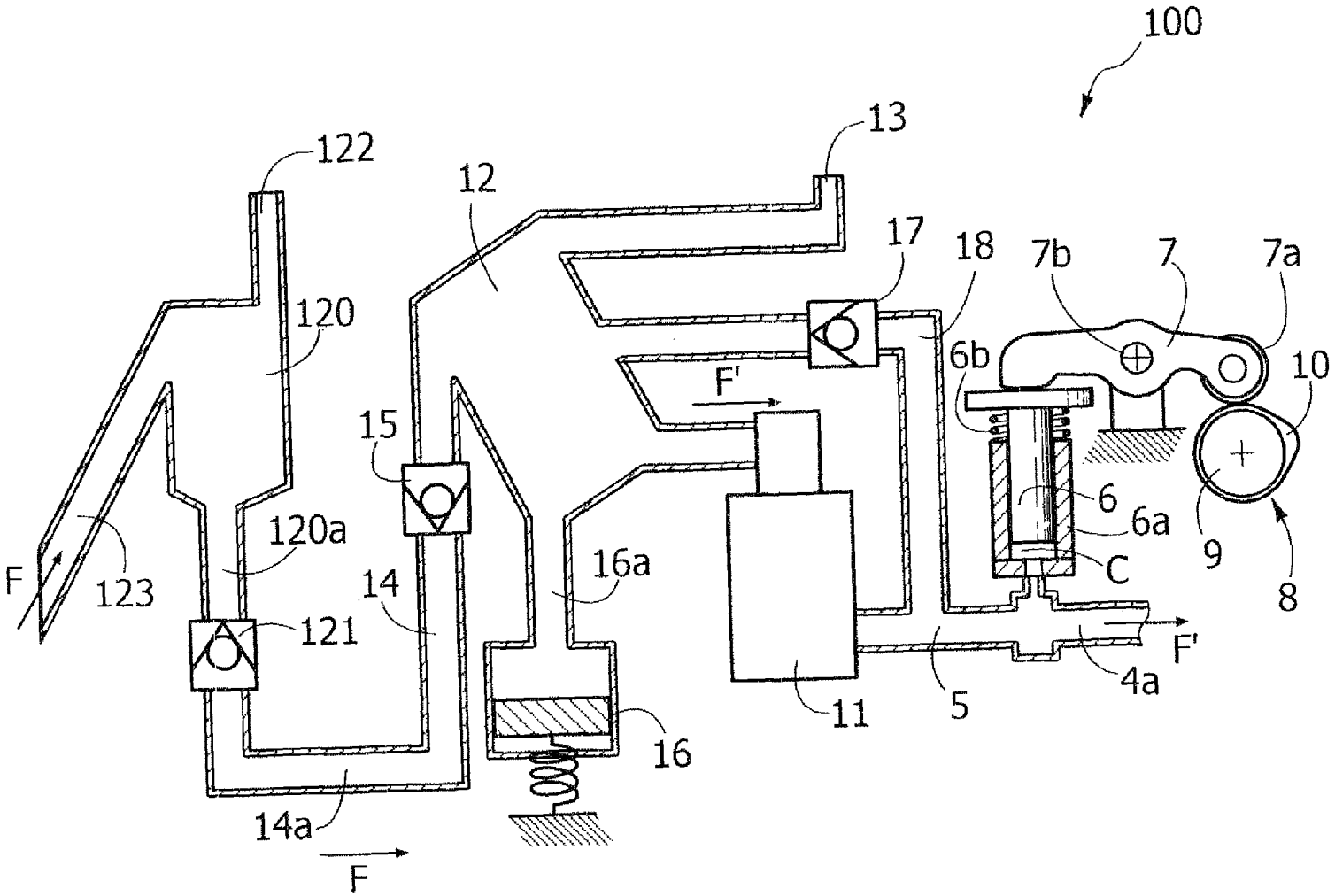

FIG. 6 shows a further embodiment of the system 100, wherein, similarly to FIG. 5, the components corresponding to those shown in the previous Figures have the same reference number.

In the illustrated embodiment, the high pressure check valve 17 is arranged within a channel 18 obtained within a so-called "brick", a brick-like body, as known for example from EP1338764 B1 to the same Applicant, i.e. a preassembled unit containing the system 100 and which is arranged above the head of the engine whereon the system 100 is installed.

Figure 1:
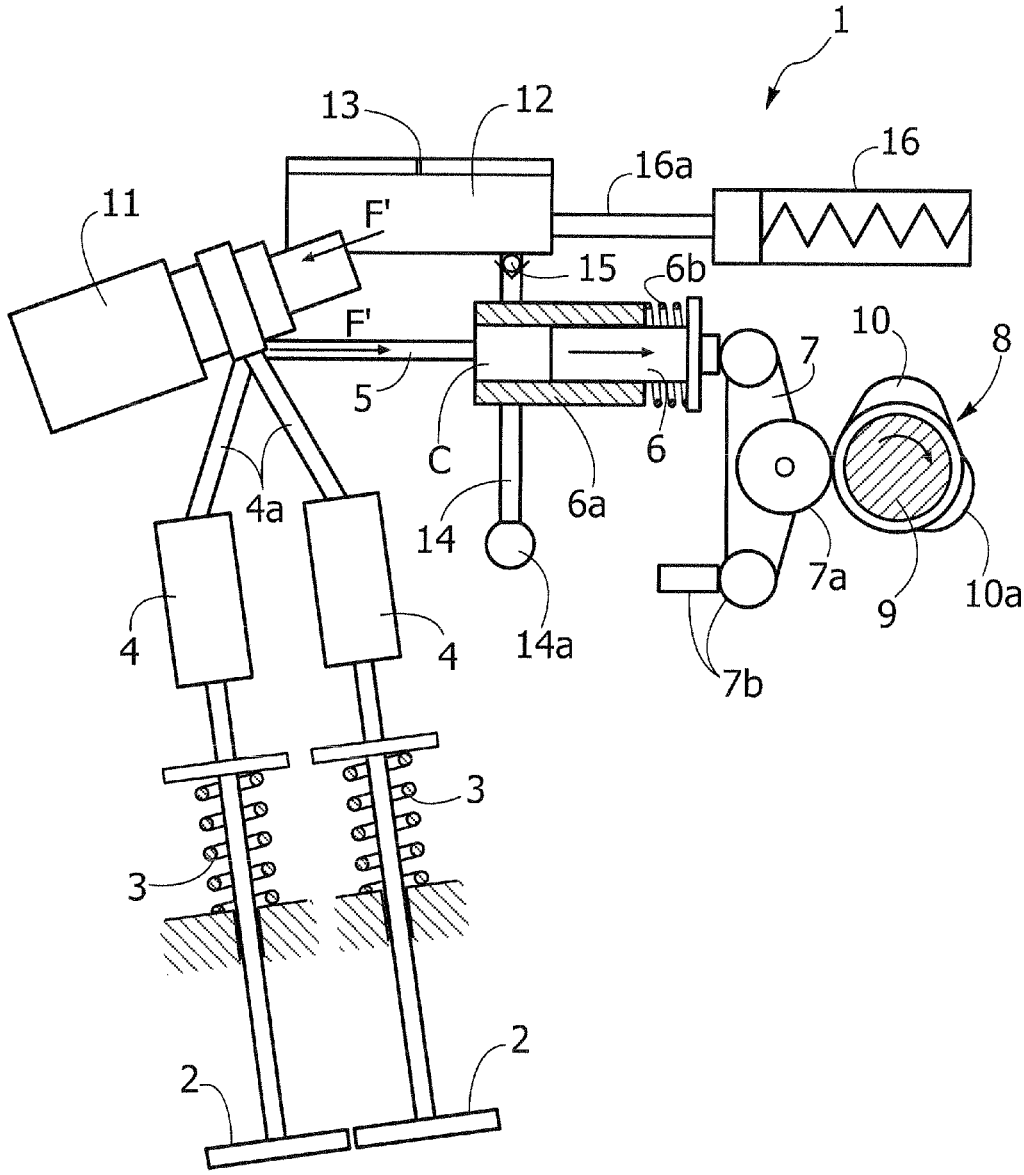
FIG. 1, previously mentioned, is a schematic view of a system for variable actuation of the valves of a known type, developed by the same Applicant.
Figure 2:
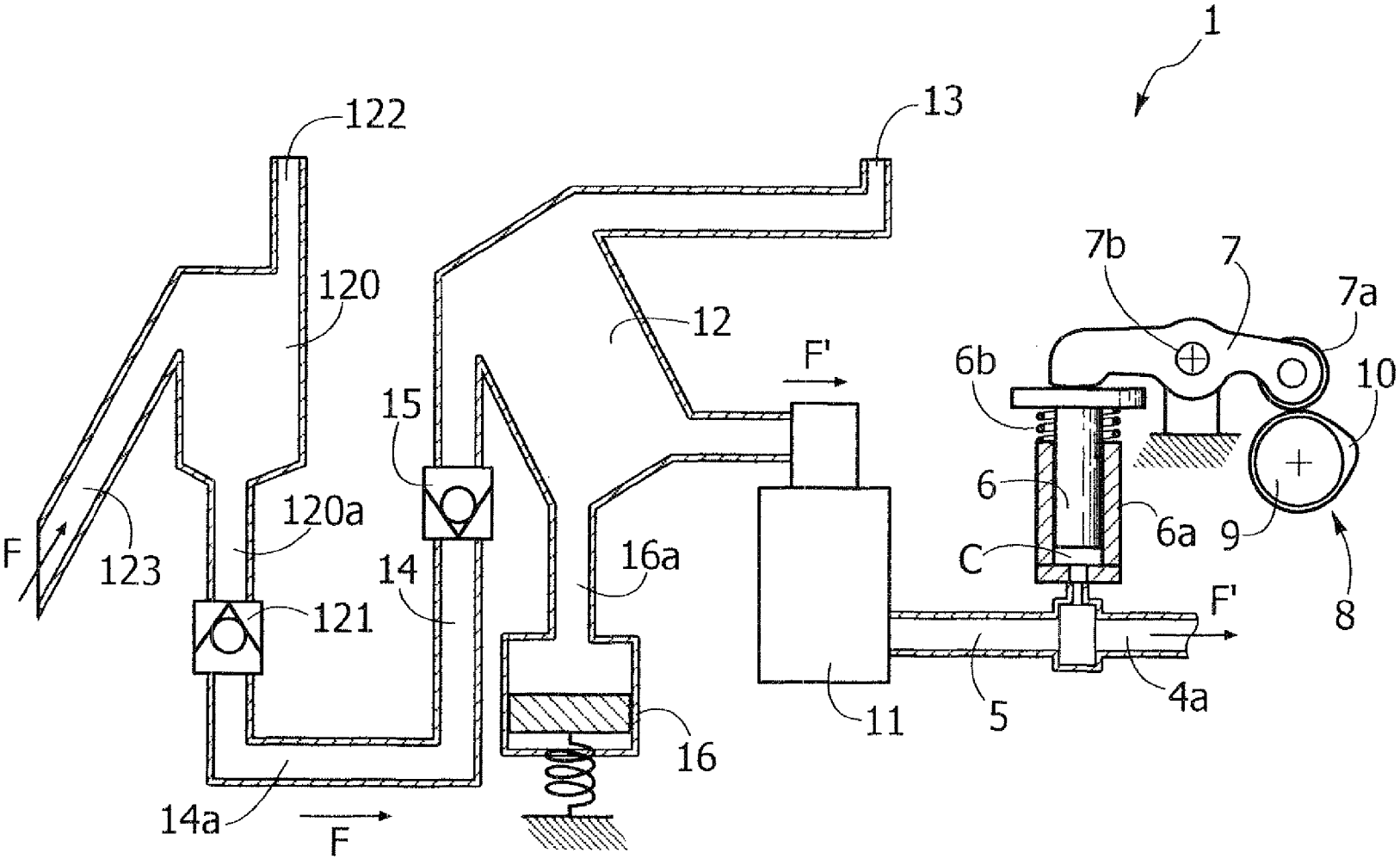
FIG. 2, previously mentioned, is a schematic view of a variant of the system for variable actuation of the valves of FIG. 1, according to what is known from EP-1555398 E1 to the same Applicant.

Similarly to the system illustrated in previous FIG. 2, this further embodiment of the system 100 comprises the second tank 120, having air bleeding means 122 and fed by the ascending supply channel 123, the intermediate channel 120*a* within which the second low pressure check valve 121 is inserted, the manifold channel 14*a* whence the hydraulic supply line 14 branches, wherein the first low pressure check valve 15 is inserted. The air bleeding means 13, 122, respectively associated with the first and with the second tank 12, 120, as previously described, can also flow out at a more remote position, referred to the tanks 120, 12, than what herein illustrated merely as a way of example.

Similarly to what has previously been described, the second tank 120 comprises an inlet for the ascending supply channel 123, located at a higher geometric level than an outlet of said second tank 120. Specifically, the ascending channel 123 has a higher geometric level than the intermediate channel 120*a*, located at the outlet of the tank 120, and than the manifold channel 14*a*.

Figure 7:
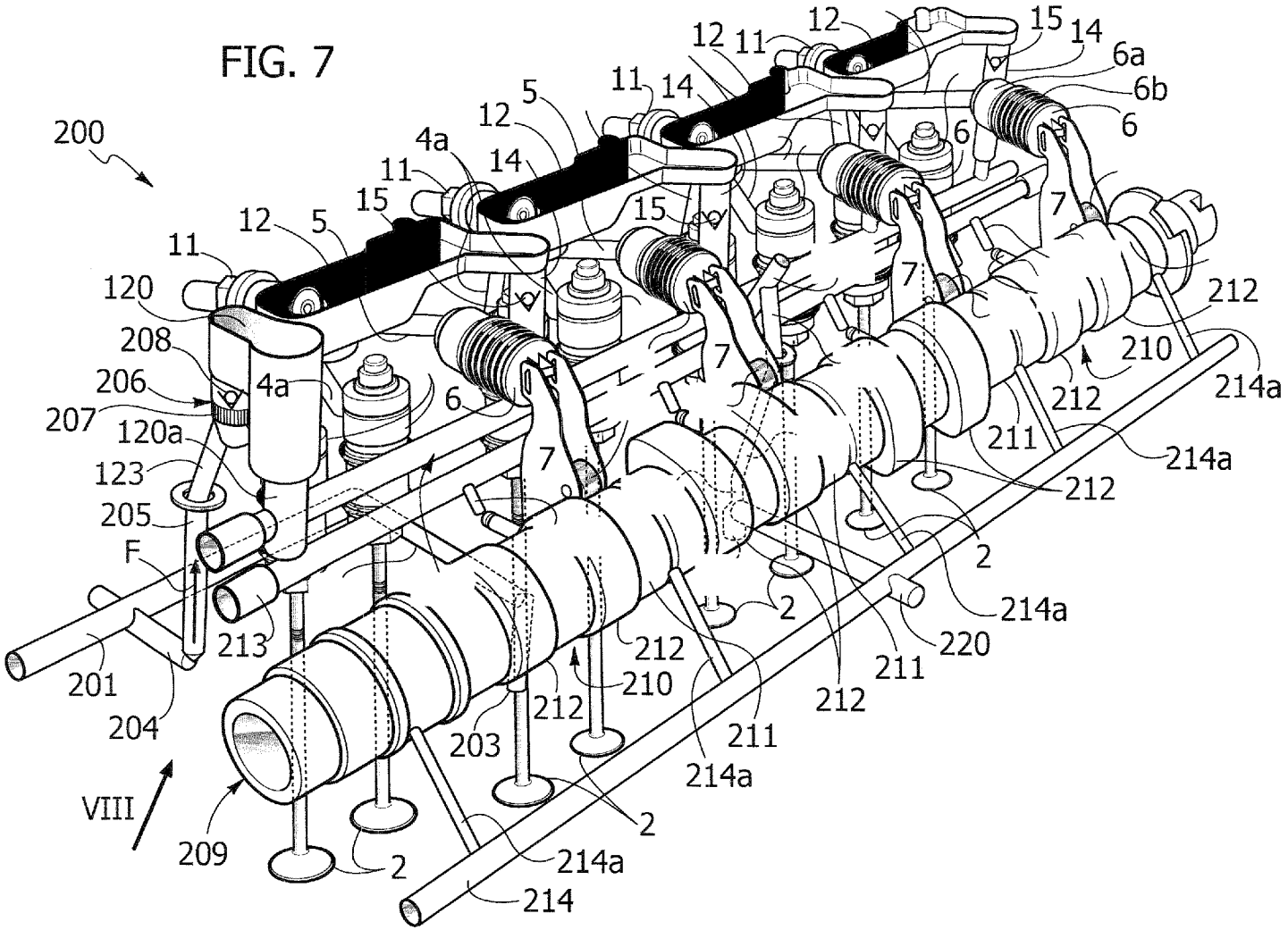
FIG. 7 is a perspective view of a constructive solution for a system for variable actuation of the valves, according to a further aspect of the present invention.

FIG. 7 shows a system 200 for variable actuation of the valves which is substantially a practical application, suitable for a multi-cylinder engine, of the system 100 of FIG. 6. Some components have been removed for the sake of clarity and some hydraulic connections have been added to the drawing, which will be described later. The components which have already been schematically illustrated and described in the previous Figures are labelled with the same reference number.

The system 200 of FIG. 7, which can be associated with an engine having in-line cylinders, comprises a channel 201 extending parallel to the engine crankshaft, and hydraulically connected with a channel 202 at right angle with it, which in turn is hydraulically connected with a channel 203 obtained within the engine head.

The channel 201 is moreover hydraulically connected to a channel 204 at right angle with it and parallel to the channel 202. The channel 204 is therefore hydraulically connected to a substantially vertical (or generally almost vertical) channel 205, which communicates with the rising channel 123. The channel 123, in this embodiment, is hydraulically connected to the tank 120 via a substantially vertical channel 206, having an increased section compared to the channel 123. Within the channel 206 there are housed a filter 207 and a check valve 208, hydraulically connected in series to each other upstream of the tank 120, which are both shown schematically. The check valve 208 is connected downstream the filter 207, taking as a reference the oil inflow direction, denoted by F in FIG. 7. The check valve 208 is adapted to allow an oil flow towards the tank 120 only, i.e. only in the direction F. It should be noticed that, due to its arrangement and to its connection, the check valve 208 is a low pressure check valve, the same as the valves 121, 15 of FIGS. 2, 6.

The channel 120*a*, not having the check valve 121 in this embodiment, branches from the tank 120 and is hydraulically connected to the manifold channel 14*a*. The manifold channel 14*a* has a higher axial length than shown in FIGS. 2, 6, and specifically such that a plurality of tanks 12 are hydraulically connected with it, through the respective hydraulic supply lines 14 (wherein the check valves 15 are arranged). On the contrary, the tank 120 is single. In the presently shown embodiment, which refers to a system 200 adapted to be used on a four cylinder in-line engine, four tanks 12, each associated to a single engine cylinder, are hydraulically connected to the manifold channel 14*a* via the corresponding hydraulic supply lines 14 branching therefrom, which is therefore a common supply channel from a functional point of view. In this way, the second tank 120 is hydraulically connected to each first tank 12.

Figure 8:
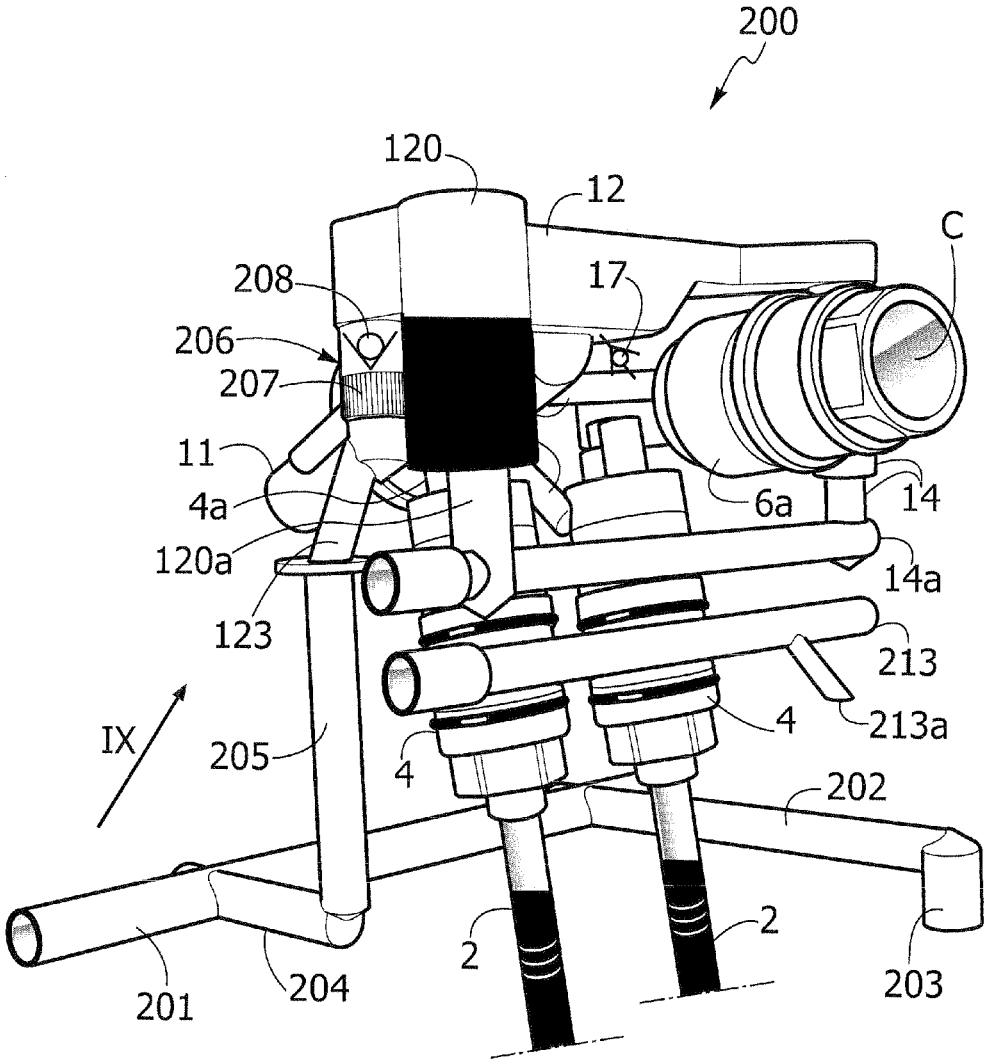
FIG. 8 is a perspective view of a detail according to the arrow VIII in FIG. 7.

To each tank 12 there is associated a group of components comprising:

the valves 2, being them intake or exhaust valves, provided with the spring return means 3, the aforesaid hydraulic means, including the pressurized fluid chamber C, hydraulically connected to the actuator 4 of each valve 2, the pumping piston 6, facing into the pressurized fluid chamber C, together with the cylinder 6*a* and the spring element 6*b*, the tappet 7 for the actuation of the pumping piston 6, the solenoid valve 11, controlled by electronic means and hydraulically connected to the pressurized fluid chamber C and to the actuator 4 of each valve 2, the hydraulic accumulator 16 (not visible in FIG. 7 of the annexed drawings), hydraulically connected to the tank 12, the second check valve 17 (FIG. 8) hydraulically connected between the tank 12 and the pressurized fluid chamber C.

However, the system 200 is fully independent from the high pressure check valve 17, and can be used also in case the latter is not envisaged.

The system 200 comprises a single camshaft 209, adapted to actuate the intake and exhaust valves of the engine and comprising cam groups 210, including a first cam 211 and second cams 212. The first cam 211 controls the valves 2 with variable actuation, i.e. operatively associated to the hydraulic means 4*a*, 5, C, to the respective actuators 4 and to each pumping piston 6, while the second cams 212 control the remaining engine valves.

Substantially, each cam 211 is equivalent to the cam 8 of FIGS. 1, 2, 5, 6.

Therefore, in correspondence with each tank 12 and to the relative associated components, an actuation sub-system of the same type as the system 100 (or as the system 1, in the case where the high pressure check valves 17 are not present) is provided. As a consequence, each actuation sub-system comprises its own low pressure side (in communication with the other sub-systems thanks to the manifold channel 14*a*) and its own high pressure side, which are functionally identical to what previously described.

In a preferred embodiment, the cams 211 are operatively associated to the intake valves, which are therefore of the variable actuation type, and are provided with respective main lobes and secondary lobes, functionally similar to the lobes 10, 10*a* of the cam 8, while the cams 212 control the exhaust valves in a conventional way.

A pair of mutually parallel channels 213, 214 extend parallel to the channel 201, 14*a*, and comprise respective branches 213*a*, 213*b* (FIG. 9) and 214*a*. The branches 213*a*, 214*a* end with an opening respectively corresponding to the fulcra 7*b* of each tappet 7 and of the camshaft 209. Moreover, referring to FIG. 9, each branch 213*b* is adapted to supply oil to a corresponding hydraulic tappet, arranged within each actuator 4 and known in itself, for example, from EP-A-1344900, EP1674673A1.

The channels 213, 214 (FIG. 7) are hydraulically connected to a channel 215, obtained within the head. Specifically, the channel 215 is hydraulically connected to a sequence of channels 216, 217, 218, 219, ending with an opening of the channel 219 corresponding to the channel 213. The channels 216 and 217, in the same way as the channels 217 and 218 and the channels 218, 219, are hydraulically connected in series with one another.

The channel 215 is moreover hydraulically connected to a channel 220, in turn hydraulically connected and at right angle with the channel 214.

The operation of the system 200 is the following.

The system 200 is entirely supplied with oil coming from the lubricating circuit of the engine whereon it is installed. Specifically, the channels 203, 215 respectively supply the channels 201 and 213, 214. The channel 201 supplies the tank 120 via the channels 204, 205, 206 and 123. Flowing through the channel 206, the oil is filtered by the filter 207 and enters the tank 120 via the check valve 208. From the tank 120 oil flows towards the manifold channel 14*a* and hence towards the tanks 12, after having passed the corresponding low pressure check valves 15.

Each tank 12 supplies oil to the corresponding actuating sub-system, whose operation is identical to what has previously been described with reference to the systems 1, 100.

The oil flowing into the channel 215 supplies the channel 220 and the sequence of channels 216, 217, 218, 219. Via the channel 220 oil flows into the channel 214, whence it is sent, through the branches 214*a*, towards the camshaft 209, so as to lubricate it.

Via the channels 216, 217, 218, 219 oil flows into the channel 213, whence it is supplied to the fulcra 7*b* of the rockers 7 via the branches 213*a*, and to the hydraulic tappets within the actuators 4 via the branches 213, as it will be better detailed in the following description.

The system 200 maintains, thanks to the high pressure check valve 17, all the previously described advantages of the system 100 as regards the filling the high pressure side of the system.

Figure 10:
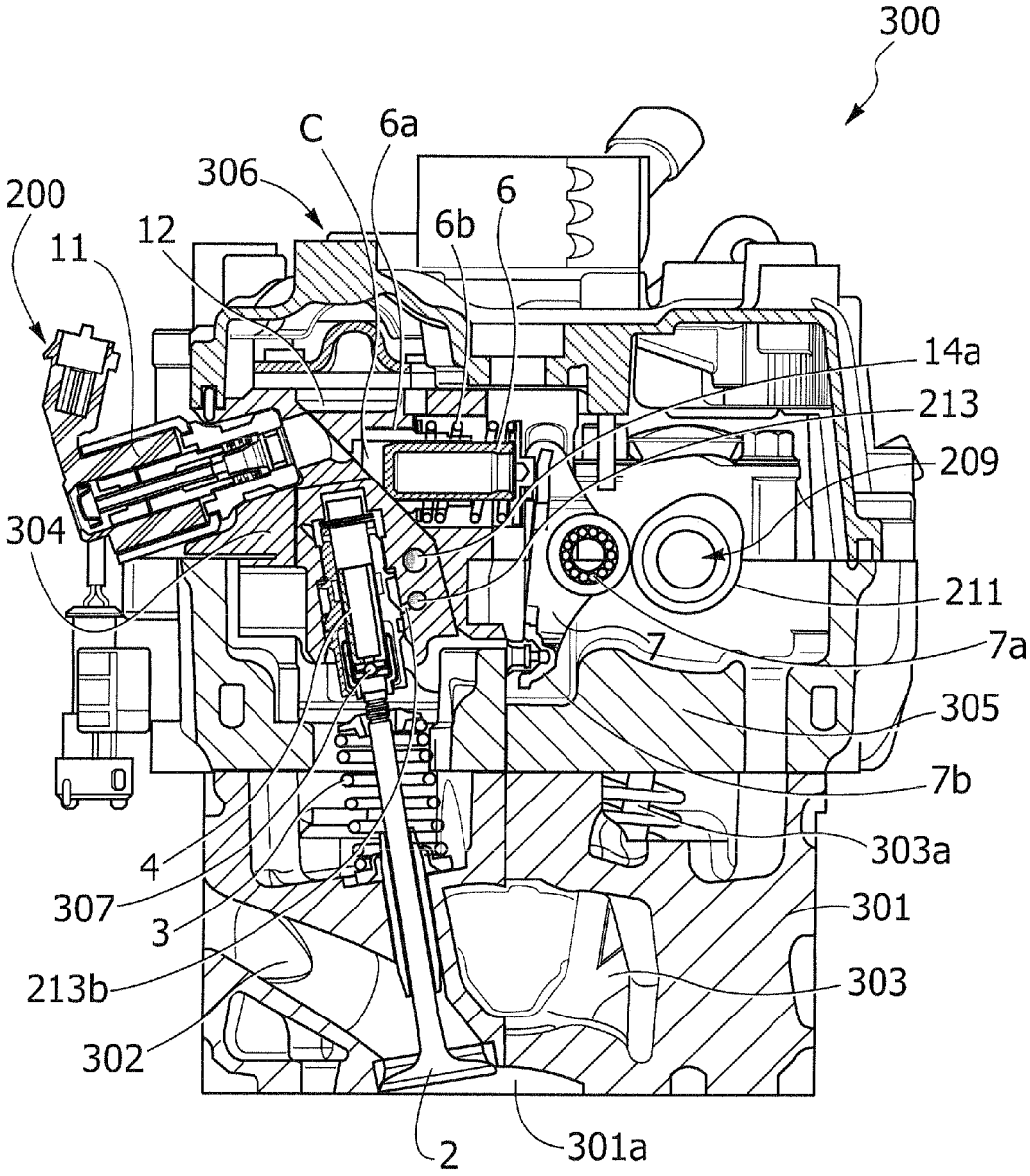
FIG. 10 is a sectional view along parallel planes of part of an internal combustion engine comprising the system of FIG. 7.

FIG. 10 shows, denoted generally with 300, a valve driving and fluid exchange system of an internal combustion engine comprising the previously described system 200. The already shown and described components have the same reference number. The Figure shows a section taken along planes orthogonal to the engine crankshaft and mutually parallel, to show simultaneously, among others, one of the valves 2 and its associated actuator 4, the pressurized fluid chamber C, the pumping piston 6 and the solenoid valve 11.

The engine valve driving and fluid exchange system 300 comprises a head 301 including walls 301*a* of an engine combustion chamber, intake ports 302 and exhaust ports 303, associated to respective intake valves and exhaust valves. In the presently shown preferred embodiment, the intake valves are the valves 2 with variable actuation, controlled by the cams 211, the above-mentioned hydraulic means C, 4*a*, 5 and the actuators 4, while the exhaust valves, denoted by 303*a*, are actuated in a conventional and not variable way, through the cams 212 (not visible in FIG. 10).

Above the head 301 there is located the system 200, installed by way of a brick-like body, previously mentioned and denoted by 304, which in turn is installed on a support block 305, a so-called cam carrier, comprising supports for the camshaft 209. It should be noted that the components of the system 200 are within the brick-like body 304 or coupled to it, in such a way that the brick-like body 304 defines a pre-assembled unit adapted to be installed above the head 301 and comprising the system 200. The channels 214, 215, 216, 217, 220 and the branches 214*a* are on the contrary obtained within the cam carrier 305, in the same way as the channels 201, 202, 203, 204, 205. The camshaft 209 is independent from the brick-like body 304 and is installed on the cam carrier 305.

Finally, the engine valve driving and fluid exchange system 300 comprises a cover member 306, extending above the system 200 and fixed to the brick-like body 304 and to the cam carrier 305. Thanks to the cover member 306, the system is isolated from the outside and is therefore protected from the penetration of dust or other foreign material.

FIG. 10 shows in section, within the brick-like body 304, the manifold channel 14*a*, the channel 213 and one of the branches 213*b*, which supplies a hydraulic tappet 307 within the corresponding actuator 4.

Figure 9:
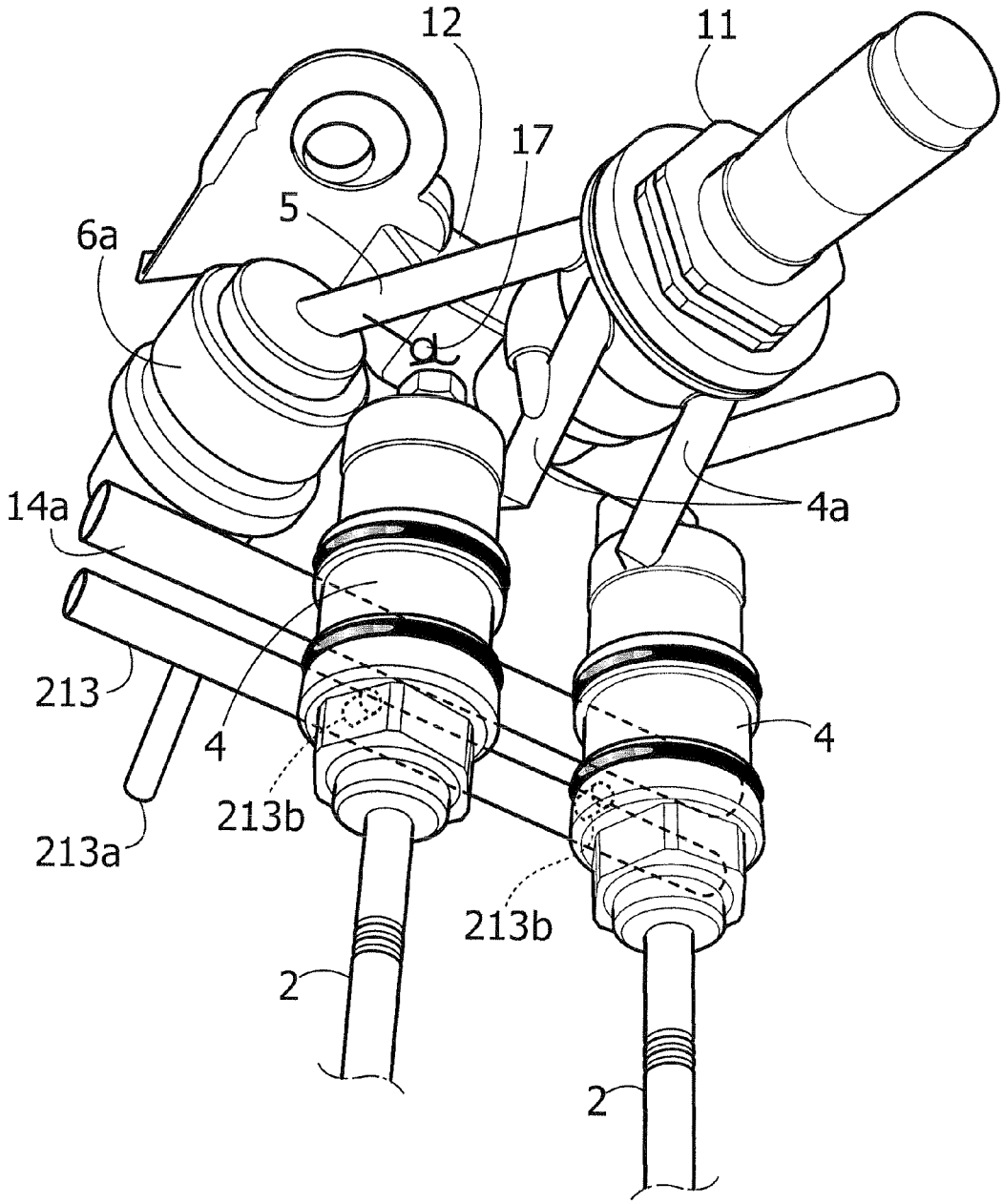
FIG. 9 is a perspective view of a detail according to the arrow IX in FIG. 8.

There is also provided, although it is not visible in FIG. 10, the high pressure check valve 17, which is anyway schematically depicted in FIG. 9. Similarly to what has been previously described, the constructive details of the check valve 17 have been omitted from the drawing for the sake of simplicity and clarity, and because this valve can be carried out in any known way.

Moreover, and as a consequence of what has been described for the system 200, the engine valve driving and fluid exchange system 300 is independent from the high pressure check valve 17, and can be constructed in the described way even in case the high pressure check valve is not present.

Of course, on the basis of the found principle, the constructive details and the embodiments may vary, even conspicuously, from what has been described and illustrated by way of example only, without departing from the scope of the present invention.

What is claimed is:

1. A system for variable actuation of the valves of an internal combustion engine, having one or more cylinders, comprising, for each cylinder:

at least one intake valve and at least one exhaust valve, each having spring return means adapted to return said at least one intake valve or said at least one exhaust valve towards a closed position, hydraulic means including a pressurized fluid chamber, said pressurized fluid chamber having a volume which is variable through the actuation of a pumping piston facing the inside thereof, said pressurized fluid chamber being hydraulically connected to an actuator of said at least one intake valve or of said at least one exhaust valve, in order to enable the variable actuation thereof, a tappet actuated by a respective cam carried by a camshaft, in order to control said pumping piston and consequently said actuator of said at least one intake valve or said at least one exhaust valve with variable actuation by said hydraulic means, a solenoid valve, hydraulically connected to said pressurized fluid chamber and to said actuator, said solenoid valve being adapted to set a hydraulic connection of said pressurized fluid chamber and of said actuator with an exhaust environment, in order to uncouple said at least one intake valve or said at least one exhaust valve with variable actuation from the respective tappet and to cause the closing thereof by said spring return means, a first tank defining said exhaust environment, a hydraulic supply line of said first tank connected thereto, and having a first check valve adapted to allow a fluid flow towards said tank only, a hydraulic accumulator hydraulically connected to said first tank, Wherein the system comprises a second check valve hydraulically connected between said first tank and said pressurized fluid chamber, said second check valve being adapted to allow a fluid flow only out of said first tank, towards said pressurized fluid chamber, said second check valve and said solenoid valve being hydraulically connected in parallel to each other, and being both adapted to allow the fluid supply from said first tank to said pressurized fluid chamber, wherein said first tank comprises air bleeding means, wherein said first tank associated to each engine cylinder is hydraulically connected to a second tank located upstream of said first check valve, wherein there is provided the said second tank as one single tank, hydraulically connected to said first tanks of the cylinders of said engine via a single manifold channel, whence the hydraulic supply lines branch connected to the corresponding first tanks, wherein said second tank comprises an inlet for an ascending supply channel located at a higher geometric level as compared to an outlet of said second tank, wherein the system comprises a further check valve downstream of said outlet of said second tank, said further check valve being adapted to allow an oil to flow out from said second tank only, wherein said second tank comprises air bleeding means including a hole provided at the top of said second tank, and wherein the system further comprises a filter and a check valve hydraulically connected in series upstream of said second tank, said check valve being adapted to allow an oil flow only towards said second tank.

2. The system for variable actuation of the valves according to claim 1, wherein it comprises a single camshaft adapted to actuate the intake and exhaust valves of said internal combustion engine, said camshaft comprising first cams controlling said valves with variable actuation through said hydraulic means, and second cams controlling the remaining valves of said engine.

3. The system for variable actuation of the valves according to claim 2, wherein said valves with variable actuation are intake valves.

4. The system for variable actuation of the valves according to claim 3, wherein each of said first cams comprises a main lobe, adapted to control a main lift of said valves with variable actuation, and a secondary lobe, adapted to control a lift of said valves with variable actuation of a reduced amount compared to said main lift.

* * * * *